US008579770B2

(12) United States Patent
Smith

(10) Patent No.: US 8,579,770 B2
(45) Date of Patent: Nov. 12, 2013

(54) PULL CORD STARTER DOCK

(76) Inventor: Tom Smith, Yorba Linda, CA (US)

( * ) Notice: Subject to any disclaimer, the term of this patent is extended or adjusted under 35 U.S.C. 154(b) by 260 days.

(21) Appl. No.: 13/074,334

(22) Filed: Mar. 29, 2011

(65) Prior Publication Data

US 2011/0177923 A1 Jul. 21, 2011

Related U.S. Application Data

(63) Continuation-in-part of application No. 12/455,685, filed on Jun. 5, 2009, now Pat. No. 7,935,035, which is a continuation-in-part of application No. 12/072,776, filed on Feb. 28, 2008, now Pat. No. 7,563,210.

(60) Provisional application No. 60/920,250, filed on Mar. 27, 2007.

(51) Int. Cl.

| | |
|---|---|
| ***A63B 21/22*** | (2006.01) |
| ***A63B 21/00*** | (2006.01) |
| ***A63B 23/14*** | (2006.01) |

(52) U.S. Cl.

USPC ..... 482/110; 482/92; 482/45; 482/44

(58) Field of Classification Search

USPC ..... 482/110, 148, 44, 45, 92

See application file for complete search history.

(56) References Cited

U.S. PATENT DOCUMENTS

| | | | | |
|---|---|---|---|---|
| 5,287,832 | A * | 2/1994 | Uhl | 123/185.3 |
| 6,053,846 | A * | 4/2000 | Lin | 482/44 |
| 6,083,076 | A * | 7/2000 | Saint-Victor | 446/242 |
| D457,922 | S * | 5/2002 | Christianson | D21/461 |
| 6,419,544 | B1 * | 7/2002 | Parker et al. | 446/233 |
| 7,102,258 | B2 * | 9/2006 | Shen | 310/50 |
| 7,437,961 | B2 * | 10/2008 | Dworzan | 74/5.47 |
| 2005/0101440 | A1 * | 5/2005 | Chuang et al. | 482/45 |
| 2006/0070594 | A1 * | 4/2006 | Pattullo | 123/179.18 |
| 2007/0266805 | A1 * | 11/2007 | Dworzan | 74/5.7 |

* cited by examiner

*Primary Examiner* — Loan Thanh
*Assistant Examiner* — Shila Jalalzadeh Abyane
(74) *Attorney, Agent, or Firm* — Clement Cheng

(57) ABSTRACT

A gyroscopic exerciser starting dock has a starter dock housing and a starter dock axle mounted within the starter dock housing. A driving wheel is mounted to the starter dock axle. A retractable pull cord grip sleeve device is mounted to the starter dock axle and has a pull handle attached to a pull cord. The pull handle is for pulling the pull cord, and the pull cord is attached to the handle at a pull cord first end. A spool receives around it a pull cord and a pull cord is attached to the spool at a pull cord second end. The spool member receives and stores the pull cord in a coil around the spool.

7 Claims, 7 Drawing Sheets

PULL CORD STARTER DOCK

The present invention is a continuation in part of Smith, Tom Ser. No. 12/455,685 Gyroscopic Exerciser filed Jun. 5, 2009 which is a continuation in part of Smith, Tom Ser. No. 12/072,776 Gyroscopic Exerciser filed Jun. 5, 2009, which claims priority from Smith, Tom 60/920,250 Gyroscopic Exerciser filed Mar. 27, 2007.

FIELD OF THE INVENTION

The present invention is in the field of gyroscopic exerciser starting devices.

DISCUSSION OF RELATED ART

The precession driven gyroscopic wrist exerciser was first invented by Archie L. Mishler and patented Apr. 10, 1973 in U.S. Pat. No. 3,726,146, the disclosure of which is incorporated herein by reference. The Mishler abstract provides an excellent primer regarding the kinematic physics behind the standard gyroscopic wrist exerciser. Jerrold W. Silkebakken further improved precessional stability adding a sectioned ring within the race patented Apr. 24, 1979 in U.S. Pat. No. 4,150,580.

Gyroscopes typically have a rotor which needs to be started in a rotational manner before the gyroscope can achieve an operating state. A variety of gyroscopic starting mechanisms have been described in the prior art.

SUMMARY OF THE INVENTION

A gyroscopic exerciser starting dock has a starter dock housing and a starter dock axle mounted within the starter dock housing. A driving wheel is mounted to the starter dock axle. A retractable pull cord grip sleeve device is mounted to the starter dock axle and has a pull handle attached to a pull cord. The pull handle is for pulling the pull cord, and the pull cord is attached to the handle at a pull cord first end. A spool receives around it a pull cord and a pull cord is attached to the spool at a pull cord second end. The spool member receives and stores the pull cord in a coil around the spool.

A one-way bearing is mounted to the spool member and the starter dock axle. The one-way bearing member allows rotation of the spool member in one direction around the longitudinal spin axis, but stops rotation of the spool member in the opposite direction. The one-way bearing has a bearing housing with a bearing housing exterior surface which is mounted to the spool member.

A spring is coiled around the axle and has a first inside end attached to either the grip sleeve housing or the spool, and a second outside end attached to either the grip sleeve housing or the spool. The spring is biased when a user pulls the pull cord away from the spool, and the spring retracts the pull cord when the user releases the pull cord. The spring biases the spool to rewind the pull cord after the cord is pulled and released, so that pulling the pull cord provides a positive engagement to rotate the driving wheel adapted to engage a gyroscopic exerciser rotor.

Optionally, a driving surface can be mounted on the driving wheel. A driving surface has an annular profile formed on the driving wheel and a driving protrusion having an annular profile formed on the driving surface. A stabilizer fin is mounted to the docking station housing. A spool protrusion can be formed on the spool so that the spring is coiled around the spool protrusion, and the spring is mounted to an exterior surface of the spool protrusion. The spool protrusion preferably has a generally circular profile.

The gyroscopic wrist exerciser that the starting dock drives will have a gyroscopic rotor including a rotor balanced around a primary axis of rotation, and a secondary axis of precession. A casing housing contains the gyroscopic rotor. The gyroscopic wrist exerciser also has a rotor axle upon which the rotor is mounted. The rotor axle is oriented to have a longitudinal spin axis in the horizontal direction, and the rotor axle has a pair of opposite ends of the axle. An annular racetrack rotatably holds the axle at the opposite ends of the axle which are shaped to rotate in the annular racetrack. The annular racetrack is oriented about the precession axis crossing the longitudinal spin axis. The precession axis is perpendicular to the longitudinal spin axis, and the opposite ends fit into the annular racetrack formed as a groove with a circumferential profile disposed around an internal circumferential surface of the housing, allowing both rotation and precession of the gyroscopic rotor and axle.

Alternatively, the retractable grip sleeve device can be formed as a pair of paws pivotally mounted on a paw plate. A paw mesa can be formed on a side of the driving wheel. Preferably, the paw mesa has a plurality of notches engagable by paw tips in either a clockwise or counterclockwise direction. A large gear receives force from a handle gear drive mounted on the handle, and the large gear transmits force to a reduced gear, so that the reduced gear transmits force to a paw gear when the handle is actuated by a user.

Embodiments of the invention will now be described by way of example with reference to the accompanying drawings.

Figure 1:
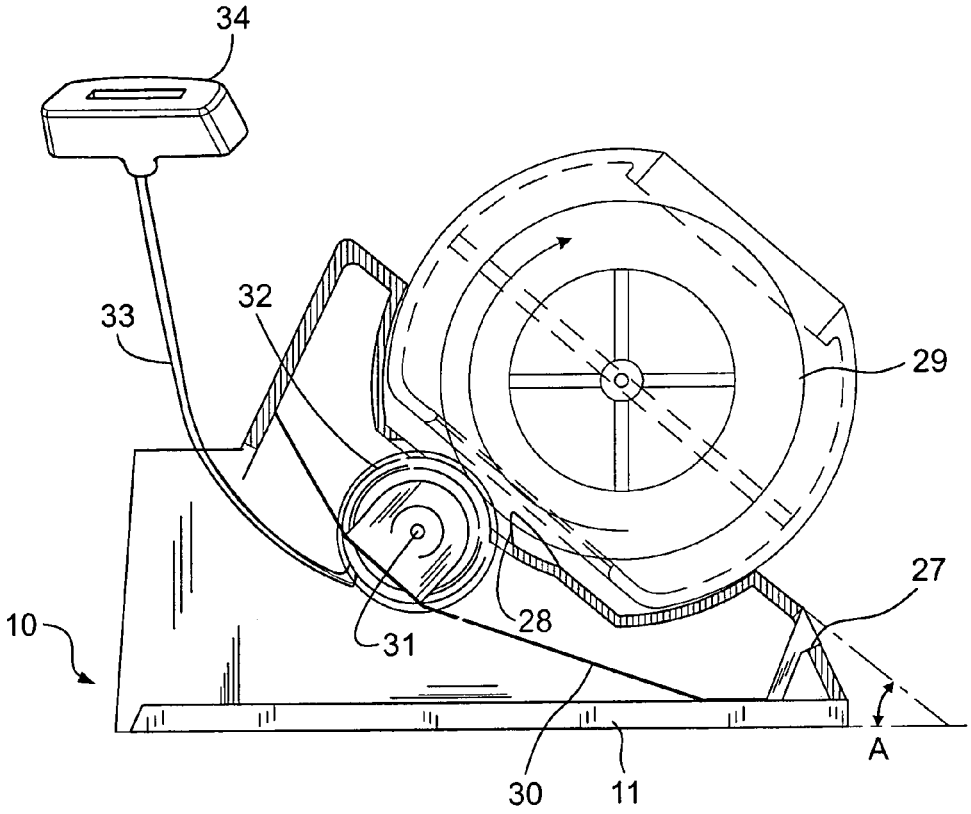
FIG. 1 is a partial cross-section view of a docking station with a pull cord handle extending from the docking station.
Figure 2:
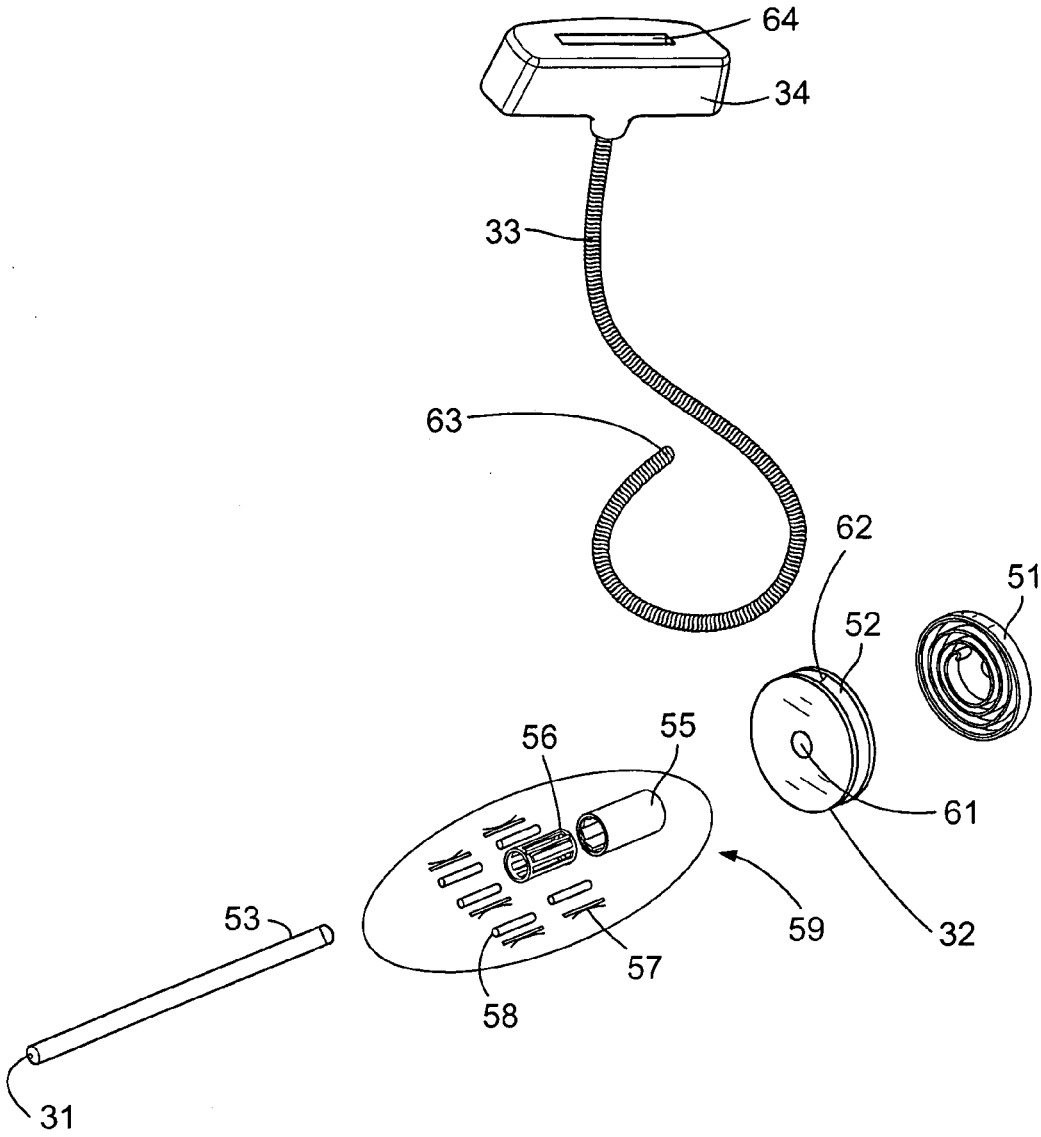
FIG. 2 is an exploded view of the retracting pull cord mechanism showing the assembly of the retracting pull cord mechanism.
Figure 3:
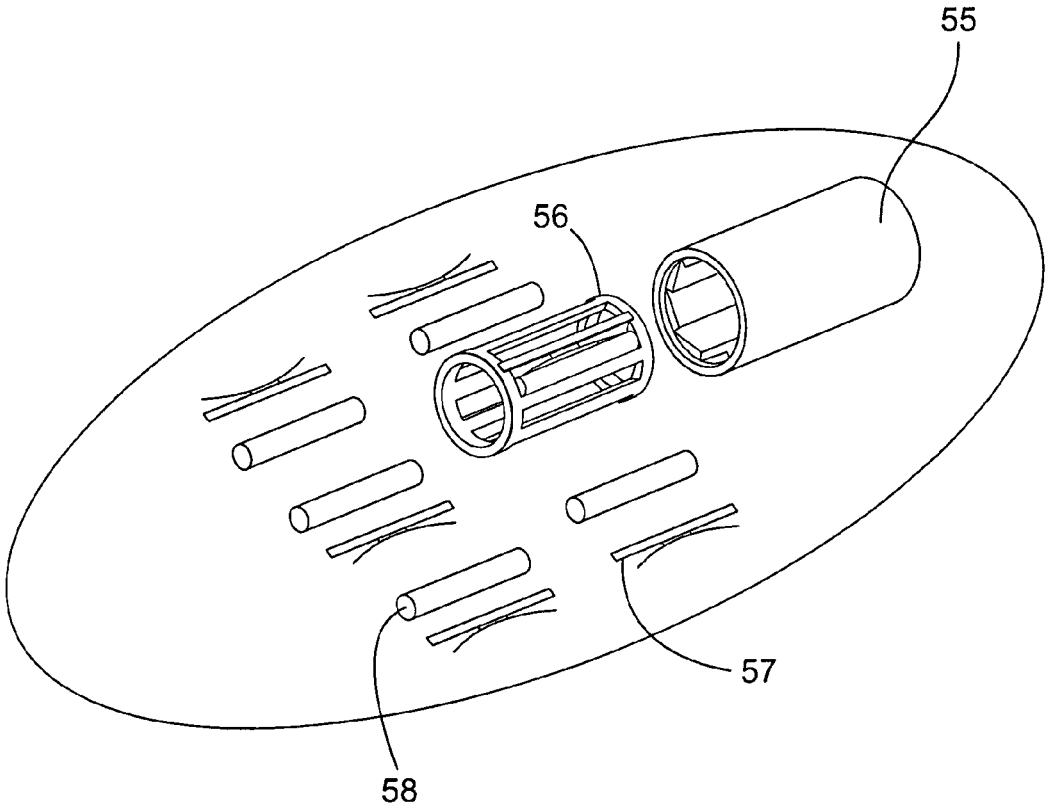
FIG. 3 is an exploded view of the one-way bearing showing assembly of the one-way bearing.
Figure 4:
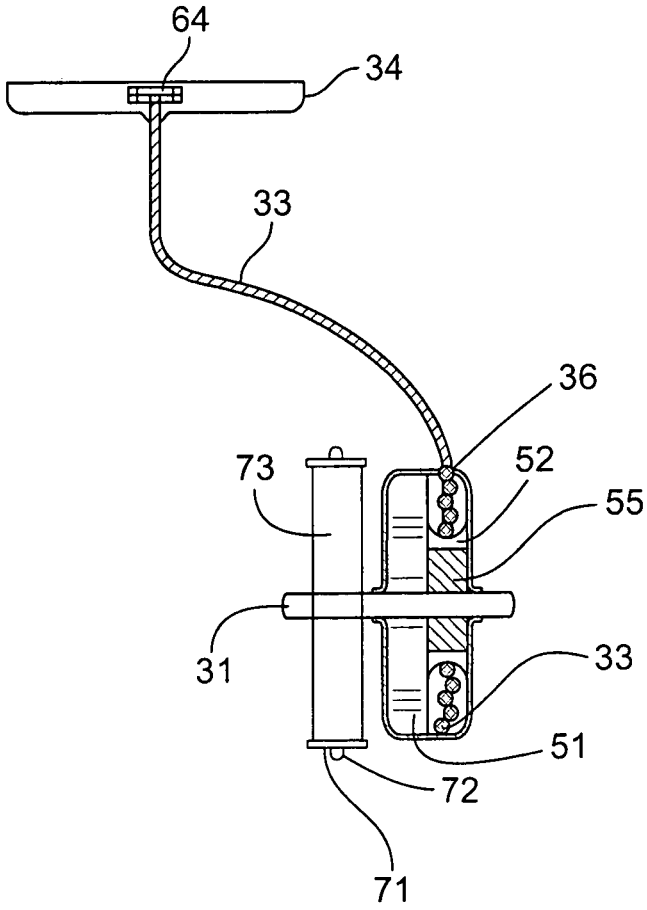
FIG. 4 is a cross-sectional assembled view of the pull cord starter device connected with the flywheel.
Figure 5:
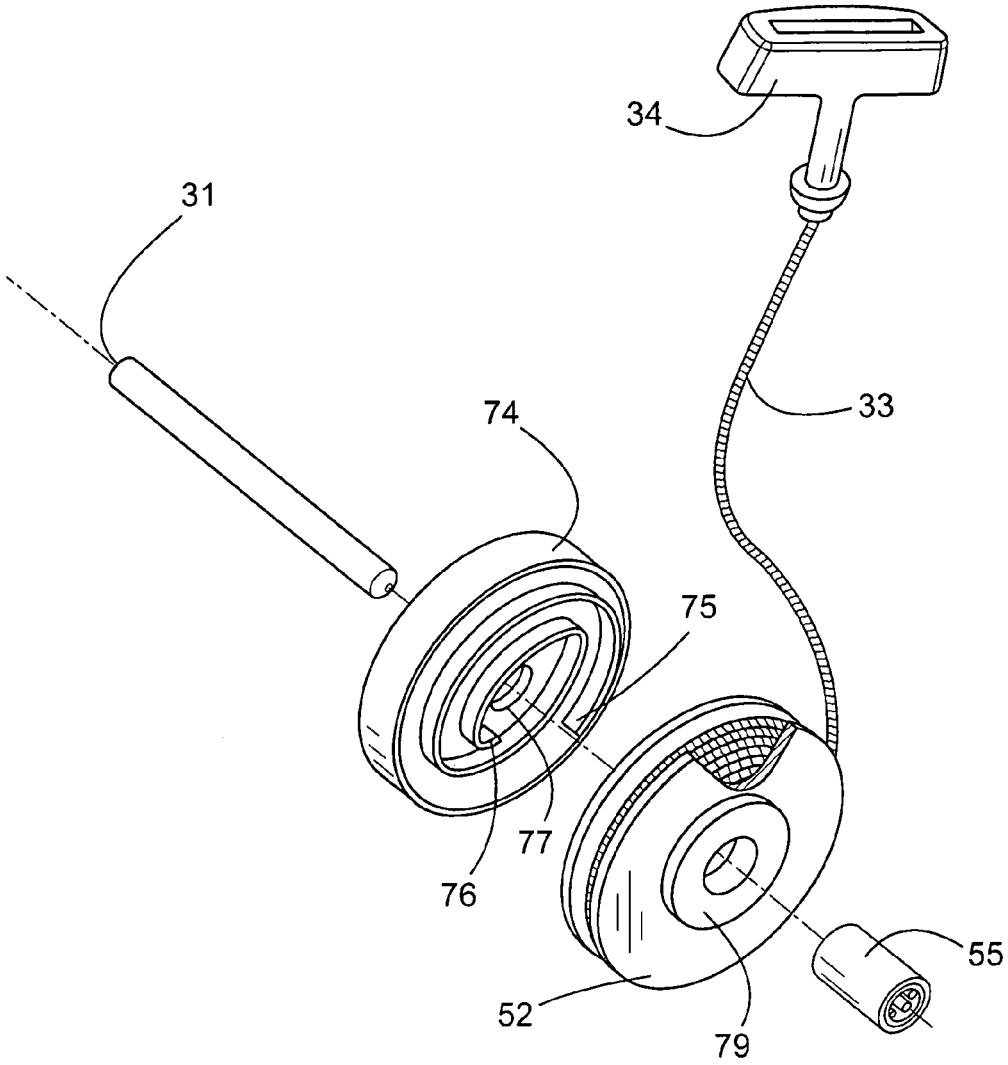
FIG. 5 is an exploded view of the retracting pull cord mechanism showing spring connection.

The following call out list of elements can be a useful guide in referencing the figures of the drawings.

10 Docking Station
11 Docking Station Base
27 Docking Station Housing
28 Stabilizer Fin
29 Rotor
30 Retracting Pull Cord Mounting Member
31 Axle Axis
32 Retractable Cord Assembly
33 Pull Cord
34 Pull Cord Handle
35 Retractable Cord Assembly Housing
36 Retractable Cord Assembly Housing Opening
51 Coil Spring
52 Spool
53 Axle
55 One-Way Bearing
56 Bearing Cage

57 Bearing Leaf Spring
58 Needle Bearing
61 Spool Opening
62 Spool Groove
63 Pull Cord Tip
64 Pull Cord Handle Slot
71 Driving Surface
72 Driving Protrusion
73 Flywheel
74 Coil Spring Housing
75 Coil Spring Outside End
76 Coil Spring Inside End
77 Coil Spring Housing Opening
79 Spool Protrusion
81 first axle
82 second axle
83 large gear
84 reduced gear
85 paw gear
86 paw plate
87 paw mounting openings
88 Spring
89 handle cover
91 paw tip
92 paw flat recess
93 paw mounting post
94 elastomeric engaging wheel
95 paw ramp profile
96 paw mesa
97 engaging wheel opening
98 electrical generator
99 paw ramp
199 generator opening
101 handle gear drive
102 handle bottom portion
103 handle top portion
104 handle cover axle
105 handle cover screw
106 generator coil
107 engaging wheel magnet

DETAILED DESCRIPTION OF THE PREFERRED EMBODIMENT

The pull cord starter dock 10 has pull cord 33 with a handle 34 on it. When the user places the gyroscopic wrist exerciser into the docking station, the user pulls on the handle which moves a driving wheel such as a flywheel 73 for initiating movement of the rotor 29 of the gyroscopic wrist exerciser. The user may place the gyroscopic wrist exerciser into a hollow portion of the docking station, such that the rotor 29 engages with an elastomeric grip surface of a flywheel 73. A groove on the rotor may engage with a driving protrusion 73 on the flywheel to provide superior traction. The driving protrusion is preferably an annular protrusion having a rounded outer profile and integrally formed with a driving surface 71 which forms a substrate of the driving protrusion. The user may pull the pull assembly repeatedly to increase the speed.

Instead of a retractable grip sleeve mounted to a rotor as in previous retractable pull cord starting devices, the retractable grip sleeve can be mounted to an external docking station starter. A retractable starting hand pull can work by itself, or in conjunction with an electric starter. It is preferred to have only the retractable starting hand pull embodiment by itself without any need for electric starting. A user preferably presses down on the gyroscopic wrist exerciser so that the weight of the gyroscopic wrist exerciser, or the weight of the user will engage the groove of the rotor with the driving protrusion or the driving surface. As the gyroscopic wrist exerciser increases in speed, a stabilizer fin 28 maintains protrusion into the groove of the rotor for the purpose of maintaining alignment of the rotor with the rotation of the driving surface and driving protrusion. The stabilizer fin can be made of plastic of the same material as a housing, and receiving a metal sheath over its exterior surface. After the pull cord starter dock 10 starts up the rotation of the gyroscopic wrist exerciser, the user may remove the gyroscopic wrist exerciser from the pull cord starter dock 10.

The axle 53 has an axle axis 31 and both are mounted within the docking station housing 27 above the docking station base 11. The retractable cord assembly 32 has also been called a grip sleeve which has a housing that is mounted for free rotation relative to the axle in one direction, but is not freely rotating in the other direction. The retractable cord assembly has a subassembly called the grip sleeve because the grip sleeve grips on the axle and turns it in a single direction but does not grip and turn it in the other direction. The grip sleeve is a sleeve because it fits around the axle like a sleeve. The retractable cord assembly 32 can be mounted to the retracting pull cord mounting member 30 which can be formed as a metal leaf spring for resiliency. The retracting pull cord mounting member 30 can also be formed as a standard plastic member.

The grip sleeve housing may be made transparent, or with openings to allow a user to view the contents within. For example, large portions of the grip sleeve housing may be cut away so that a user can see the retraction of the pull cord, or the operation of the spring. The key portion of the grip sleeve housing is the aperture from which the pull cord passes through. The grip sleeve housing provides a secure relationship between the pull cord aperture and the spool. The grip sleeve housing can be made as a traditional housing having an enclosure around the elements within, or the grip sleeve housing can be made as a stick like member or stick like frame connecting between the pull cord aperture and the spring subassembly housing. The preferred construction is to have an enclosure with or without stylized apertures. The housing can be made as a sphere or cylinder with a single opening for the pull cord.

The handle is preferably connected to a swivel member that is attached to the pull cord. The preferred construction of the handle connection to the pull cord is to have a knot tied to the end of the cord which fits over a washer so that the washer does not pull through over the knot. The washer then fits within the pull cord handle slot 64 of the pull cord handle 34 where the washer rotates when necessary to alleviate binding forces on the cord.

The pull cord passes through a slot which holds a retractor mechanism, also called the retractable cord assembly. The grip sleeve has a one-way bearing 55 that is mounted and held in a spool 52 that has sidewalls for retaining a coil of pull cord 33. Those sidewalls of the spool form a spool groove 62 which retains the pull cord 33 within it. Because the one-way bearing 55 rotates in a certain direction, it would not rotate both counterclockwise and clockwise. Therefore, when the cord is being pulled away from the spool, the spool binds with the axle through the one-way bearing. Instead of the spool spinning around the axle, the spool imparts a rotational force to the axle which rotates the axle.

After a user has pulled the pull cord out of the spool, the pull cord can be held in an extended position such that when the flywheel spins, the cord 33 of the retractable cord assembly 32 including the grip sleeve and the components within including the coil spring 51 and the spool 52 do not move relative to the housing. The pull cord tip 63 is connected to the spool so that a user does not pull the pull cord from the spool. During held extended position, the axle rotates and the flywheel rotates. After pulling the pull cord out of the spool, a retractor mechanism is necessary for retracting the pull cord back into the spool.

The spool is rewound by the coil spring. The coil spring is connected to the spool preferably at a spool protrusion 79 which is a raised part above the coil spring. A pair of spool protrusions 79 can be formed on a left face and a right face of the spool 52. The spool protrusion preferably has a flat face which is parallel to the axle axis. The flat face of the spool protrusion is generally parallel to the face of the axle 53. The spool protrusion is preferably of the same thickness as the coil spring 51. The tip of the coil spring, namely the coil spring inside end 76 is preferably mounted to the flat face of the spool protrusion such that the coil spring winds around the spool protrusion. The coil spring outside end 75 is preferably connected to the inside surface of the coil spring housing 74. Thus, the coil spring housing 74 is connected to the spool 52 via the coil spring 51. The coil spring housing 74 retains the coil within it and has a coil spring housing opening 77 which receives the axle 53. When the pull cord 33 is pulled from the spool, the spring receives potential energy through winding because the spool moves relative to the spring since the coil spring housing 74 is connected to the spool opening 61. As the pull cord 33 is pulled from the spool opening 61, the coil spring housing 74 is maintained in the same position while the spool 52 rotates. The coil spring 51 then pulls back the pull cord 33. The coil spring can be oriented in one direction for providing a compression potential energy which pushes the spring to a spread configuration or reversed in another direction to provide tension potential energy. It is preferred that the tension potential energy configuration is used which winds the spring in a tight coil.

When the pull cord 33 is retracting to a retracted position, the one-way bearing 55 allows the spool 52 to rotate relative to the axle. During retraction, the spool protrusion 79 may serve as a spool for the spring so that the spring winds around the circular profile spool protrusion.

A variety of different configurations can be used for configuring the retractor. The retractor housing holds the coil spring 51 next to the spool 52. The coil spring 51 is preferably made as a flat sheet of metal that is wound around the axle. The coil spring can also doubled so that a pair of coil springs sandwich the spool and one-way bearing. The docking station housing could be attached to a retractable cord assembly housing 35. The retractable cord assembly housing 35 has a retractable cord assembly housing opening 36 for the pull cord 33. A single axle 53 is preferably metal and rotates in a track which circumferentially passes around the interior of the outer housing 35. The outer housing 35 could be a transparent plastic.

The best mode for configuring the retractor is as follows, in that after a user pulls the pull assembly, the rotor begins to spin and the coil spring is extended. The spring has a tendency to recoil to its original position. As the user releases the pull assembly the spring which is connected between the retractor housing and the shaft, rotates the spool to retract the cord. The one-way bearing is oriented so that the release of the pull assembly is in the direction of the one-way bearing and that the pulling of the pull assembly is against the direction of the one-way bearing. Thus, pulling the pull assembly operates against the one-way bearing so that the shaft rotates, and releasing the pull assembly operates with the one-way bearing so that shaft rotation is not impeded. The spring has an inside end and an outside end. Preferably, the inside end is connected to the spool, while the outside end is connected to the retractor housing. The spool is connected to the one-way bearing. The one-way bearing is mounted on the axle. The axle is mounted in the pull cord starter dock housing.

A variety of one way bearings can be used for the operation of the retracting mechanism, but it is preferred to use a needle type one way bearing. The needle type one way bearing 55 has a bearing cage 56 with slots. Each slot can receive a needle bearing 58 and a bearing leaf spring 57 which has a flat protruding portion extending outwardly at an angle. For example, six needles and six leaf springs can fit into six slots of a cylindrical cage. The leaf springs have a curved portion which biases into the slot against the needle. The leaf springs also have a flat portion which extends outwardly at an angle. The flat portion that extends outwardly pushes against the inside of the needle type bearing housing. The inside surface of the housing of the needle type bearing has a plurality of ramp like slots which allow rotation of the cage in one direction, but not the other direction. For example, the cage can rotate in a counterclockwise direction, but not in a clockwise direction. When the cage rotates in a counterclockwise direction, the flat portion slips over each ridge of each ramp like slot to avoid the slot. On the other hand, when the cage rotates in a clockwise direction, the flat portion has an edge that binds into a slot of the needle type bearing housing. When the edge binds into the slot, the needle and cage are jammed and the needle stops the shaft, since the shaft is mounted in the cage. Thus, the cage could only rotate in a clockwise direction for an instant until it binds. The same cage would freely rotate normally in a counterclockwise direction. Because the external surface of the bearing housing is attached to the spool, the spool can only rotate relative to the axle in one direction.

The portion of the housing that houses the spring is preferably formed as a subassembly which is shaped as a flat tray. The spring subassembly can fit over the shaft and the one-way bearing, or the spring assembly can fit only over the shaft with the spool portion fitting over the one-way bearing. The one-way bearing increases the diameter of the shaft, and the spring subassembly housing should have an increased axial opening size for receiving the one-way bearing if it is desired to have the one-way bearing pass through the spring subassembly housing. The needle type one way bearing is the best mode and incorporates a unidirectional clutch within the bearing.

The retractor assembly spring can be extended when the pull cord is pulled, or in a retracted position when the pull cord is pulled. The retractor spring assembly is preferably a coil formed of a flat spring that has multiple rotations around the axle. The grip sleeve retains the string end. The grip sleeve fits over the bearing which fits over the axle shaft. Preferably, the spool 52 has sufficient clearance between itself and the retractable cord assembly housing 35 so that even if it may rub a little or otherwise have some frictional contact, such frictional contact would not be so great as to interfere with the rotation of the spool 52 relative to the retractable cord assembly housing 35 when a user is pulling on the cord or releasing the cord. The one-way bearing 55 should only be mounted to the spool and the axle and should not be mounted to the retractable cord assembly housing 35. The one-way bearing 55 should also have sufficient clearance between itself and the retractable cord assembly housing 35 so that it can rotate in one direction but not the other.

Optionally, the retractable cord assembly housing 35 may have an opening called a retractable cord assembly housing opening 36 to fit over the axle 53. This opening preferably does not touch the axle, but can. Preferably, only the flywheel and the one-way bearing touches the axle. The spool and the close spring housing can be mounted over the one-way bearing if necessary. If the coil spring housing is mounted over the one-way bearing, the one-way bearing is received to the coil spring housing at a close spring housing opening 77. Although the spool opening 61 is preferably secured to the one-way bearing 55, the coil spring housing can also be touching the one-way bearing as long as both are not rigidly attached to the one-way bearing.

Currently, the best mode for constructing the starter handle as a retractable starter handle is to connect the cord to the swivel element. The cord passes through the handle through an opening that is large enough for the cord to rotate relative to the opening. The swivel element can be a washer with an opening through which the cord passes. The cord can receive a knot so that the handle end of the cord is unable to pass through the opening of the washer. Using a knot allows the knot and the washer to rotate relative to the handle. The washer can be oiled so that it more easily slides relative to the inside surface of the handle. The handle can be made hollow with an opening facing upward, the handle can also be made solid so that the washer sits on a top surface.

During the process of pulling, rotational movement of the flywheel may provide a source of light when a light such as light emitting diodes are secured to a coil or magnet for the purpose of light emission. For example, if at the interface between the flywheel and the docking station housing 27, light emitting diodes secured to a coil can be rotated relative to a magnet. The magnet could be rotated with the flywheel or comprising part of the flywheel, or optionally the light emitting diodes secured to a coil could be rotated.

Figure 6:
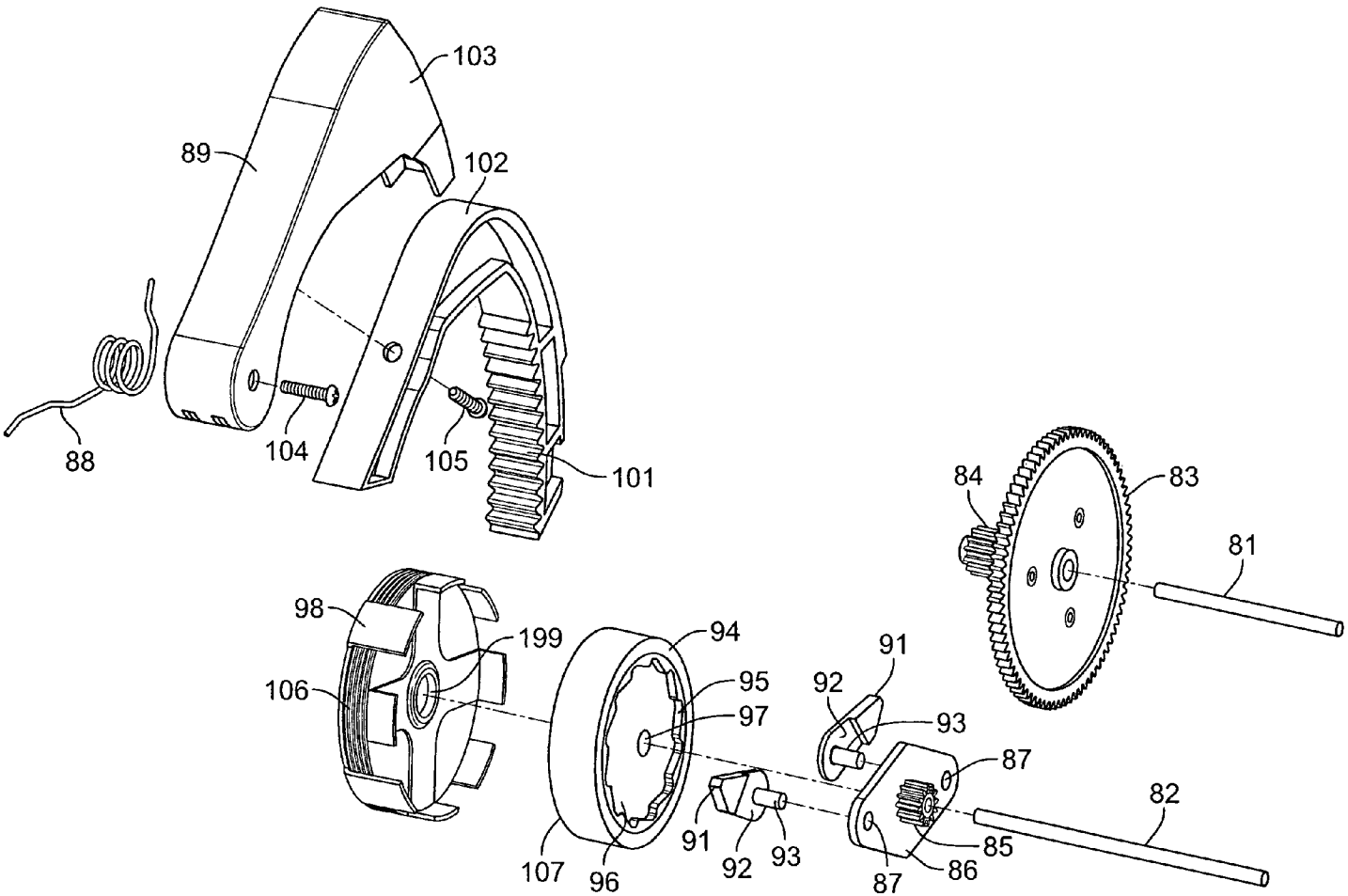
FIG. 6 is an exploded view of the ratcheting mechanism.
Figure 7:
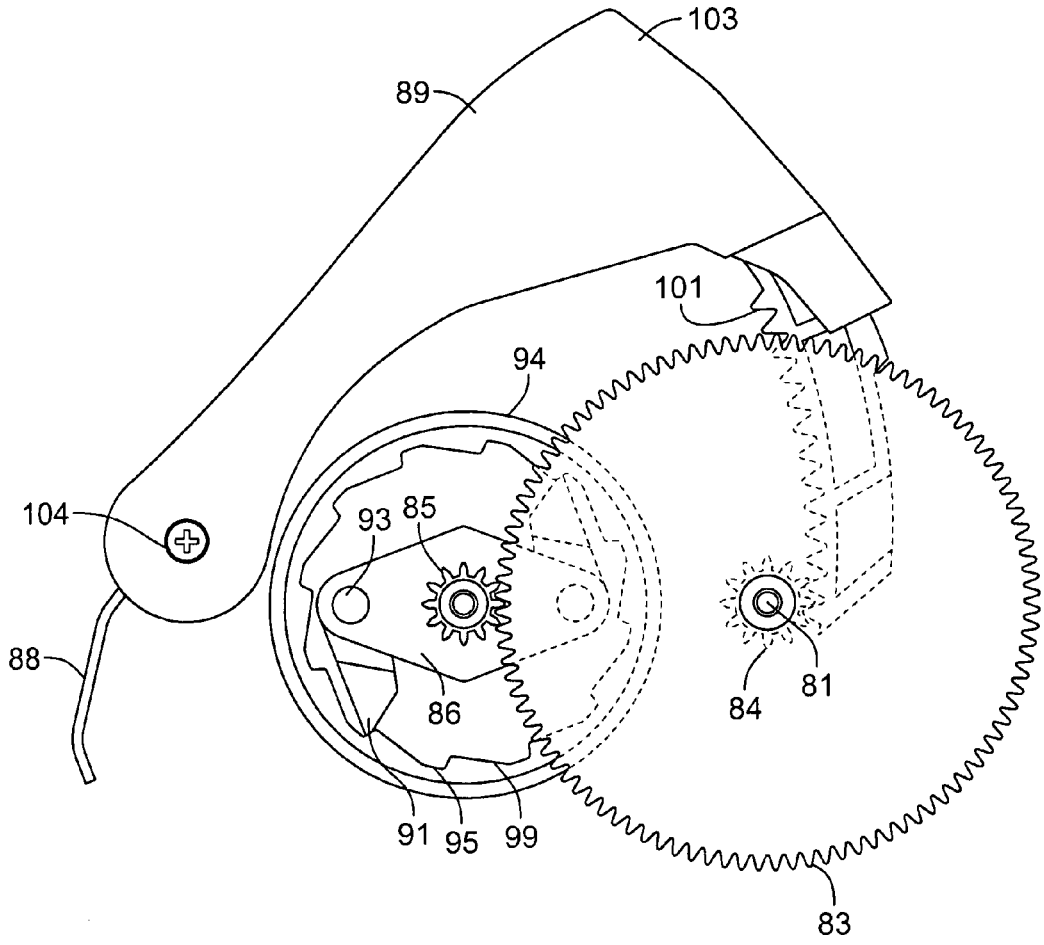
FIG. 7 is a side assembled view of the ratcheting mechanism.

Instead of a retracting pull cord, the driving surface can be rotated using a ratcheting mechanism also having a one-way driving future. The ratcheting device as seen in FIG. 6, has a handle cover 89 fitting over a handle bottom portion 102. The handle cover is a part of the handle top portion 103. Together, the handle cover, the handle bottom portion and the handle top portion formed the handle and can be attached together using a handle cover screw 105. The handle has a handle gear drive 101 which is a series of notches disposed in a sidewall surface of the handle which extends downward. The handle top portion 103 extends through an opening of the housing so that a user can press down on the handle top portion 103.

When a user presses down on the handle top portion 103, the handle top portion 103 rotates on handle cover axle 104 and the handle rotates downward into a downward position. The handle cover axle 104 can be made as a long screw which is screwed into a side portion of the housing so as to secure the handle cover axle 104 to the housing. The rotation of the handle is against a coil spring 88. The coil spring is mounted with the coil spring wrapping around the handle cover axle 104. The coil spring 88 biases against the handle being pressed downward. When the user releases the handle, the coil spring 88 restores the handle to the upward position. Thus, the handle reciprocates from upward to downward and back to upward position with successive pushing by a user.

The reciprocating motion of the handle is translated into reciprocation motion of the handle gear drive 101. The handle gear drive 101 moves substantially vertically as seen in the figures so that it engages the reduced gear 84. The reduced gear 84 is rigidly connected to the large gear 83 to provide a gear ratio. The reduced gear 84 and the large gear 83 are most mounted on a first axle 81. The first axle 81 is mounted to the housing. The first axle 81 is parallel to the second axle 82. The large gear 83 meshes with the paw gear 85 in the same way that the reduced gear 84 meshes with the handle gear drive 101.

When a user presses on the handle top portion 103, the force is transmitted to the handle gear drive 101 which transmits force to the reduced gear 84. The reduced gear 84 transmits force to the large gear 83. The large gear 83 transmits force to the paw gear 85 which rotates the paw plate 86 upon which the paw gear is affixed to. Preferably, the paw gear 85 is integrally formed with the paw plate 86 and further includes paw mounting openings 87.

The pair of paw elements each has a paw tip 91 which engages into paw ramp notches on paw ramps 99 formed on a side surface of the engaging wheel 94. When the tips engage into the notches, the paw plate 86 is prevented from moving in the counterclockwise direction. The paw plate 86 rests on the side surface of the engaging wheel 94. Also, the paws and paw tips are resting on the side surface of the engaging wheel 94. The engaging wheel is preferably elastomeric in that it has an exterior surface made of elastomeric material capable of gripping a groove of a rotor of the gyroscopic wrist exerciser.

The side of the engaging wheel 94 is formed as a paw mesa 96. During rotation in the clockwise direction, the paw and paw plate upon which the paws are mounted are all sliding over the paw mesa. The paw mesa may be greased so that there is less friction between the flat portions of engagement, and also to provide an urging bias to open the paws when the paw plate is being rotated in the counter clockwise direction. The paws tips 91 are pivotally mounted to the paw plate 86. The paw plate 86 has a pair of engaging wheel openings 97 which received paw mounting posts 93 to provide a pivoting connection. The paws have a paw flat recess 92 fitting with a flat portion of the paw plate 86.

Therefore, during operation the angle of the paws is such that the tips engage to notches in counterclockwise motion and the tips rotate freely in clockwise motion. Thus, the engaging wheel is driven in a counterclockwise direction which in turn drives the rotor of the gyroscopic wrist exerciser. The paws are another example of a one-way bearing.

Optionally, an electrical generator 98 can be attached to the housing and mounted with a generator opening 199. The second axle 82 preferably passes through the paw gear 85, the engaging wheel opening 97 and the generator opening 199. The electrical generator 98 preferably includes a generator coil 106 mounted opposite a rotating magnet 107 fountain on the backside of the engaging wheel 94. The magnet rotating relative to the coil provides an electrical output which can be used for lighting the housing of the starter dock. Electrical output is preferably direct current which illuminates light emitting diodes which in turn illuminate a semi transparent or transparent parts of a housing of the starter dock.

Although a variety of embodiments have been described, persons skilled in this art will readily appreciate that various additional changes and modifications may be made without departing from the spirit of the invention, as defined and differentiated by the following claims.

The invention claimed is:

1. A gyroscopic exerciser starting dock comprising:

a. a starter dock housing;

b. a starter dock axle mounted within the starter dock housing;

c. a driving wheel mounted to the starter dock axle;

d. a retractable grip sleeve device mounted to the starter dock axle comprising:

i. a handle attached to a reciprocating starter;

ii. a one-way bearing, wherein the handle is configured to bias the one-way bearing in a driving direction;

iii. a spring biasing the handle to a starting position when the handle is released;

e. a pull cord, wherein the handle is a pull handle and is configured for pulling the pull cord, wherein the pull cord is attached to the handle at a pull cord first end; and further comprising a spool member fitting around and attached to the pull cord at a pull cord second end, wherein the spool member receives and stores the pull cord in a coil around the spool member;

f. wherein the one-way bearing member is mounted to the spool member and the starter dock axle, and wherein the one-way bearing member allows rotation of the spool member in one direction around a longitudinal spin axis, but stops rotation of the spool member in the opposite direction, wherein the one-way bearing has a bearing housing with a bearing housing exterior surface which is mounted to the spool member; wherein the spring is a coil spring which is coiled around the starter dock axle and has a first inside end attached to either a grip sleeve housing or the spool member, and a second outside end attached to the other of the grip sleeve housing or the spool member, wherein the spring is biased when a user pulls the pull cord away from the spool member, and wherein the spring retracts the pull cord when the user releases the pull cord, whereby the spring biases the spool member to rewind the pull cord after the cord is pulled and released; and g. a stabilizer fin, wherein the stabilizer fin maintains protrusion into a groove of a gyroscopic rotor of a gyroscopic exerciser; whereby pulling the pull cord provides a positive engagement to rotate a driving wheel adapted to engage the gyroscopic rotor.

2. The gyroscopic exerciser dock of claim 1, wherein the gyroscopic exerciser comprises a gyroscopic wrist exerciser adapted to be engaged with the gyroscopic exerciser starting dock, wherein the gyroscopic wrist exerciser further comprises:

a casing housing containing the gyroscopic rotor; and an axle upon which the gyroscopic rotor is mounted, wherein the axle comprising a pair of opposite ends, and is oriented to have a longitudinal spin axis in a horizontal direction, wherein the gyroscopic rotor is balanced around a primary axis of rotation and a secondary axis of precession.

3. The gyroscopic exerciser starting dock of claim 2, further comprising: a driving surface mounted on the driving wheel.

4. The gyroscopic exerciser starting dock of claim 2, further comprising: a driving surface having an annular profile formed on the driving wheel and a driving protrusion having an annular profile formed on the driving surface.

5. The gyroscopic exerciser starting dock of claim 2, further comprising: a spool protrusion, wherein the spring is coiled around the spool protrusion, wherein the spring is mounted to an exterior surface of the spool protrusion.

6. The gyroscopic exerciser starting dock of claim 1, further comprising: a spool protrusion, wherein the spring is coiled around the spool protrusion, wherein the spring is mounted to an exterior surface of the spool protrusion.

7. The gyroscopic exerciser starting dock of claim 1, further comprising: a driving surface having an annular profile formed on the driving wheel and a driving protrusion having an annular profile formed on the driving surface.

* * * * *